United States Patent [19]

Steiner

[11] Patent Number: 4,522,307

[45] Date of Patent: Jun. 11, 1985

[54] CHILD-RESISTANT TAMPER-EVIDENT CLOSURE

[75] Inventor: Gerald E. Steiner, Lancaster, Ohio

[73] Assignee: Anchor Hocking Corporation, Lancaster, Ohio

[21] Appl. No.: 543,334

[22] Filed: Oct. 19, 1983

[51] Int. Cl.[3] ..... B65D 55/02

[52] U.S. Cl. ..... 215/219; 215/256

[58] Field of Search ..... 215/219, 220, 251, 253, 215/256, 258

[56] References Cited

U.S. PATENT DOCUMENTS 3,837,518 9/1974 Gach ..... 215/219

3,974,929 8/1976 Montgomery ..... 215/222

*Primary Examiner*—George T. Hall

*Attorney, Agent, or Firm*—Stoll, Wilkie, Previto & Hoffman

[57] ABSTRACT

A child resistant closure cap is described which is easily applied to a threaded container and which thereafter may not be removed without the initial removal of a tamper indicating band so that the closure is also tamper-evident.

4 Claims, 22 Drawing Figures

Fig. 1.
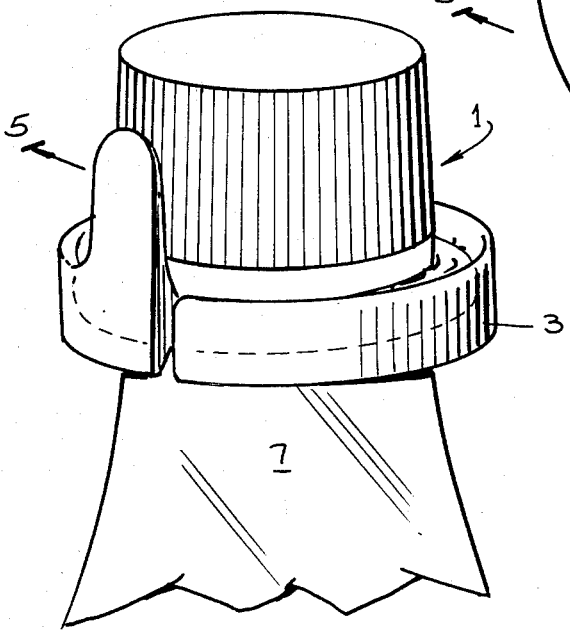
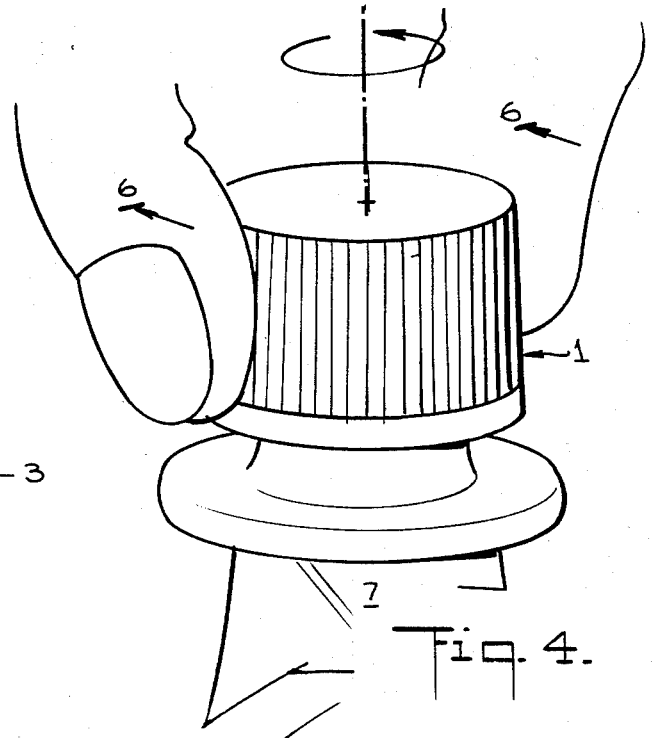
Fig. 4.
Fig. 3.
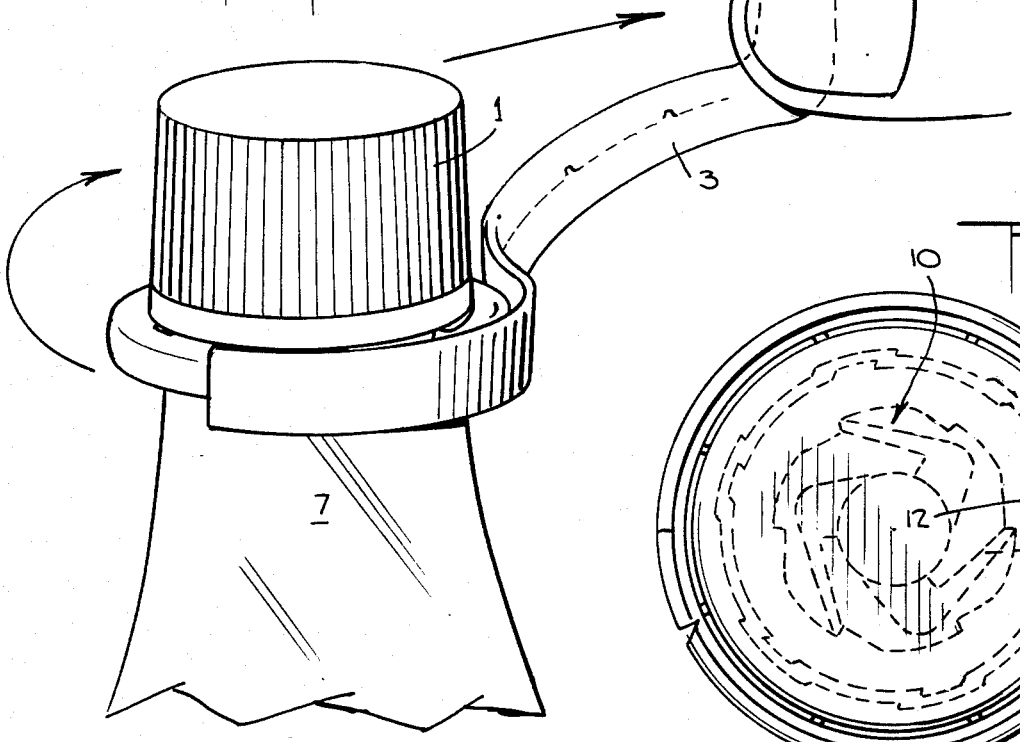
Fig. 2.
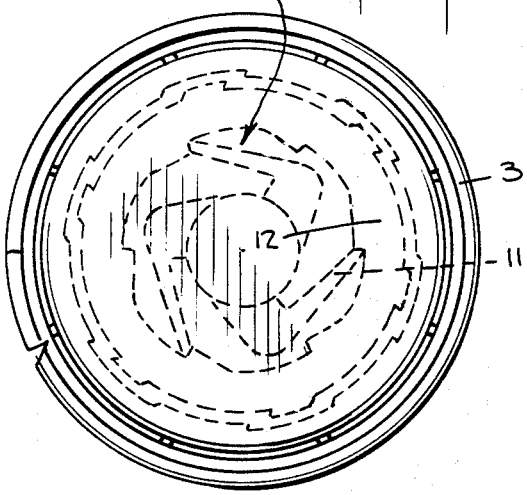

Fig. 7.
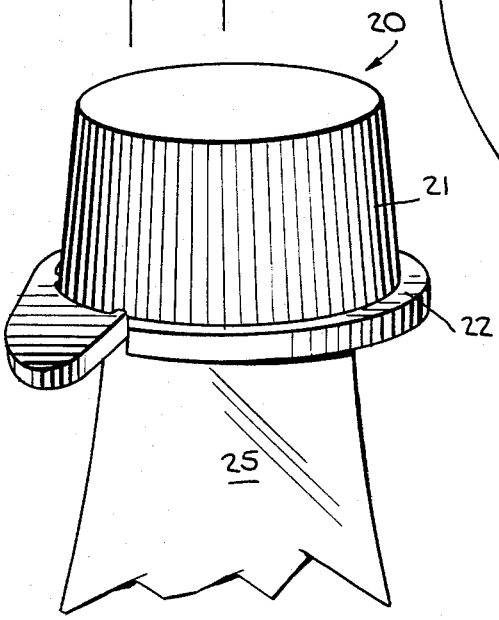
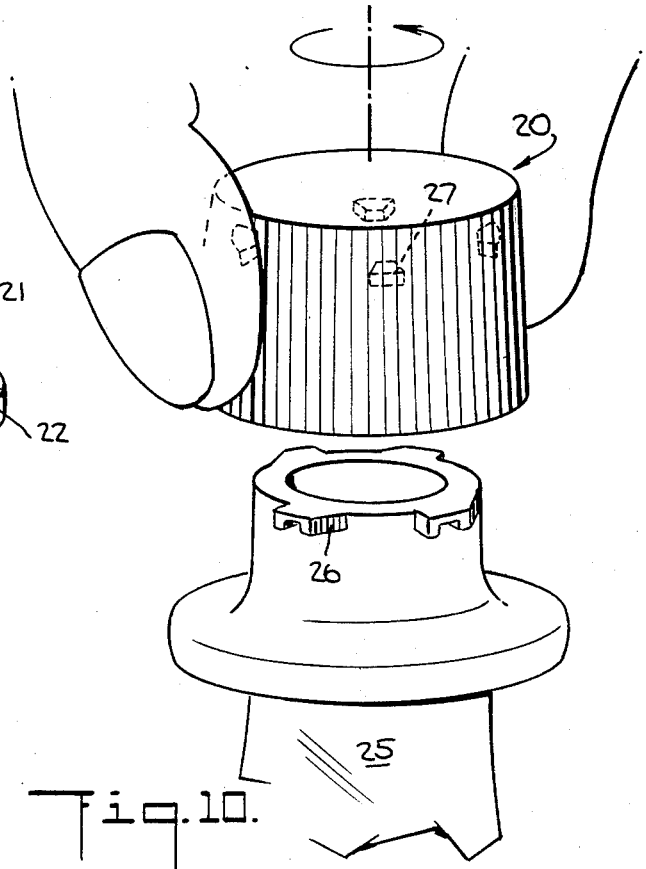
Fig. 10.
Fig. 9.
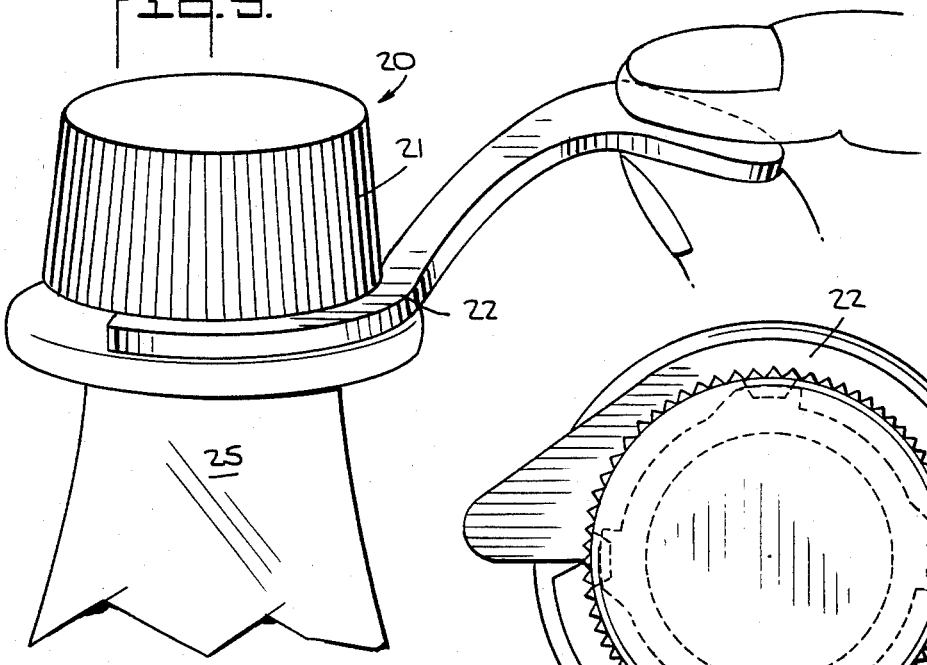
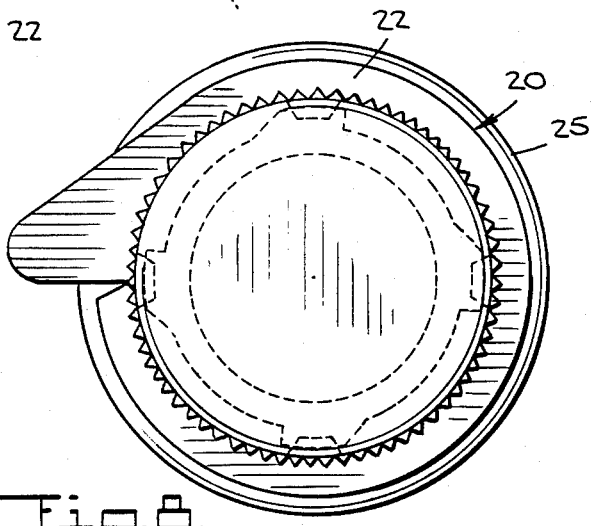
Fig. 8.

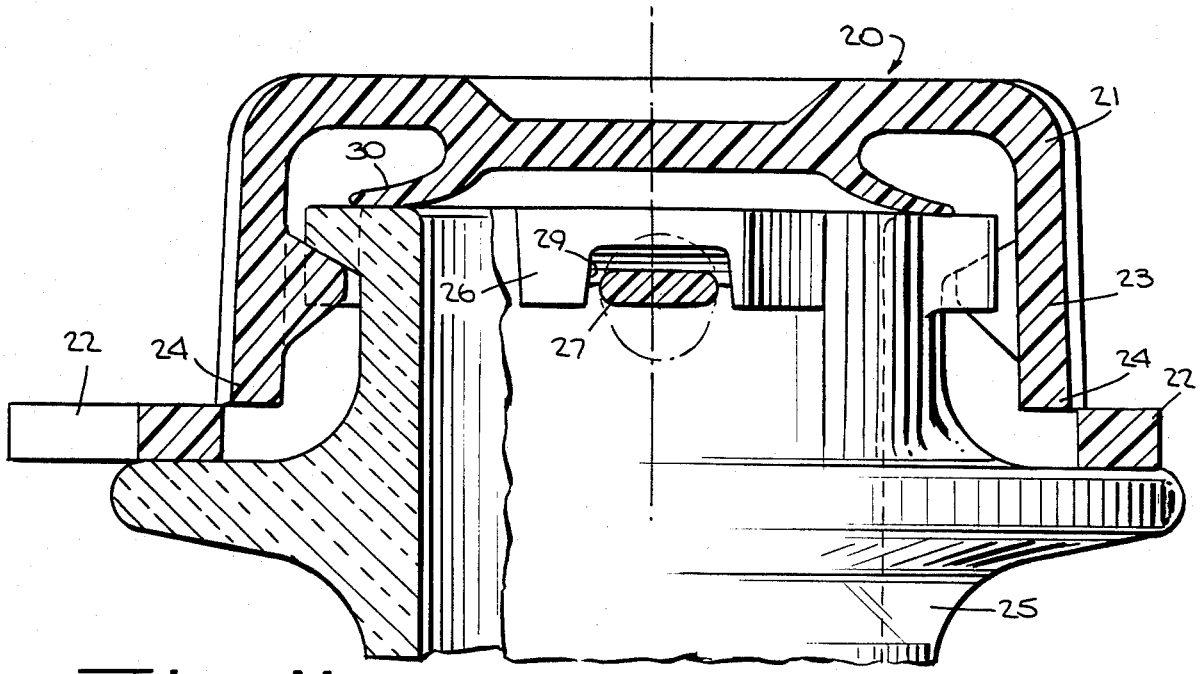
Fig. 11.
Fig. 12.
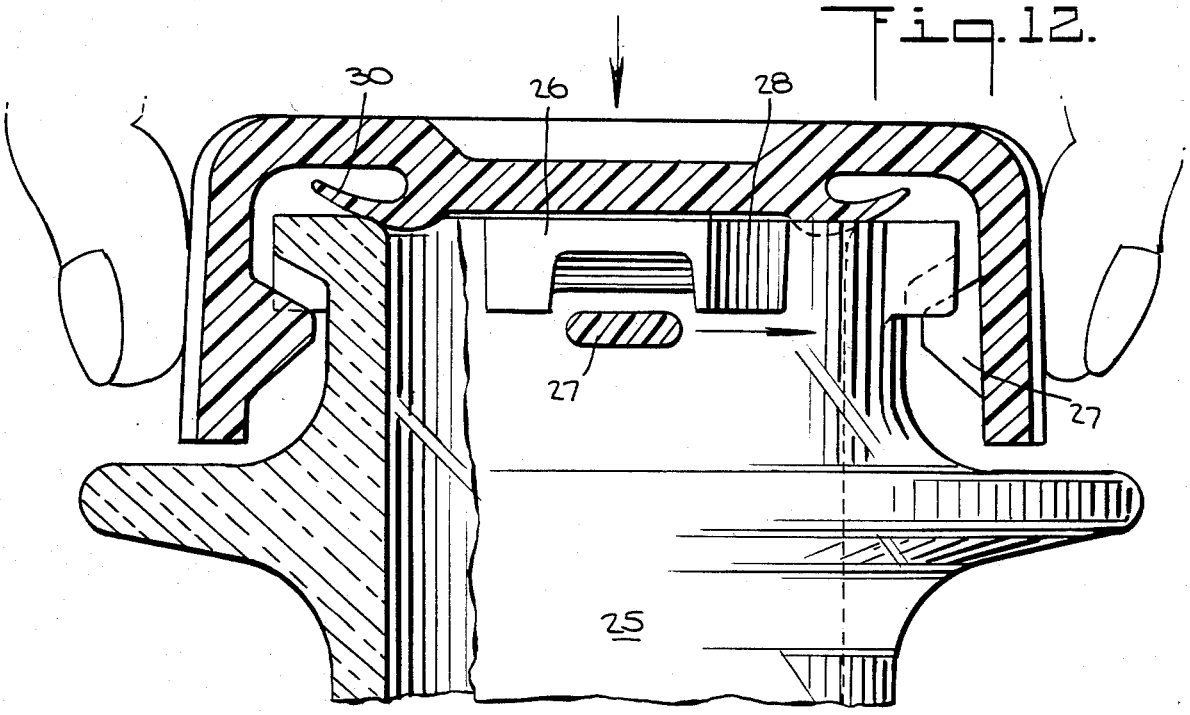

Fig. 13.
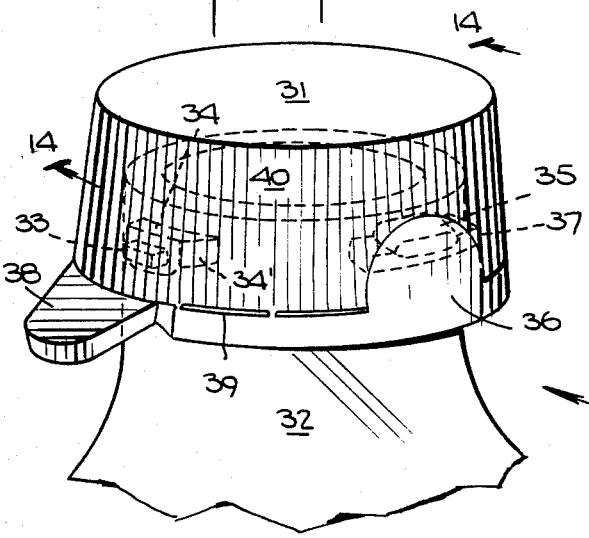
Fig. 16.
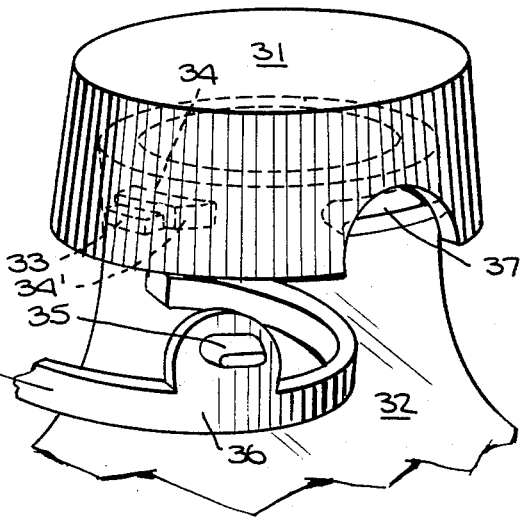
Fig. 15.
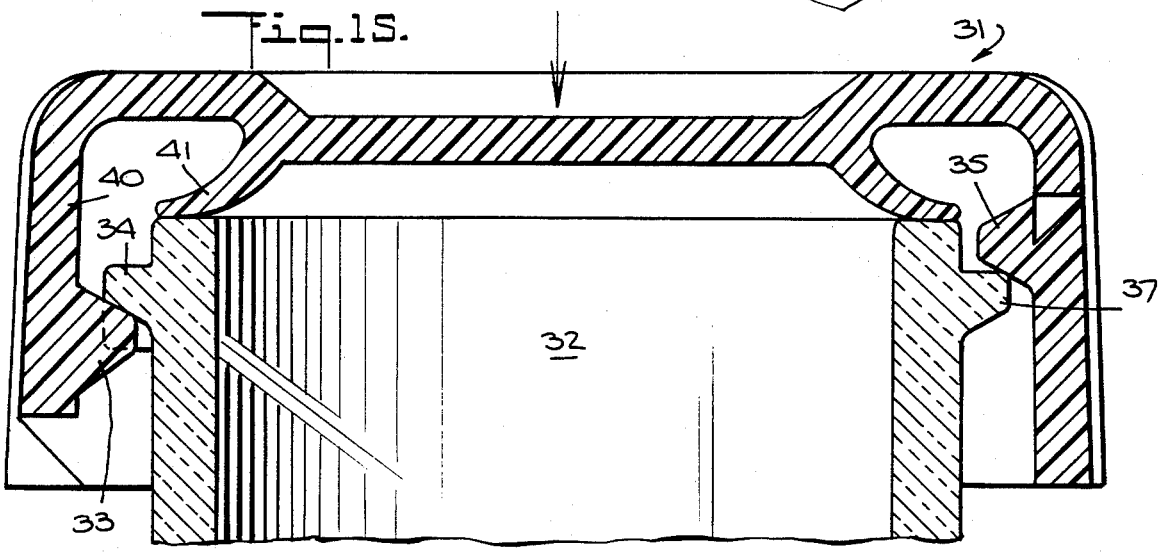
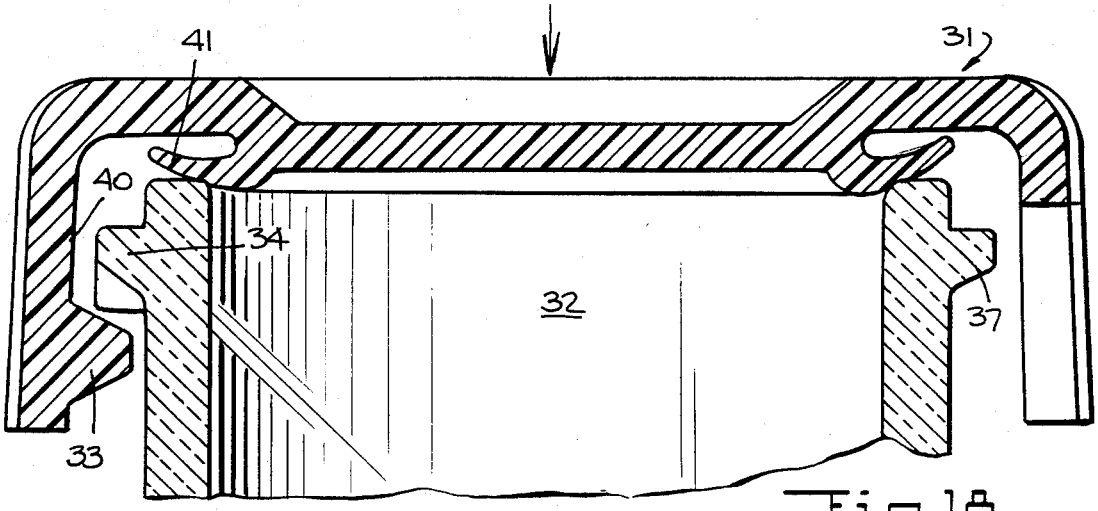
Fig. 18.

Fig. 14.
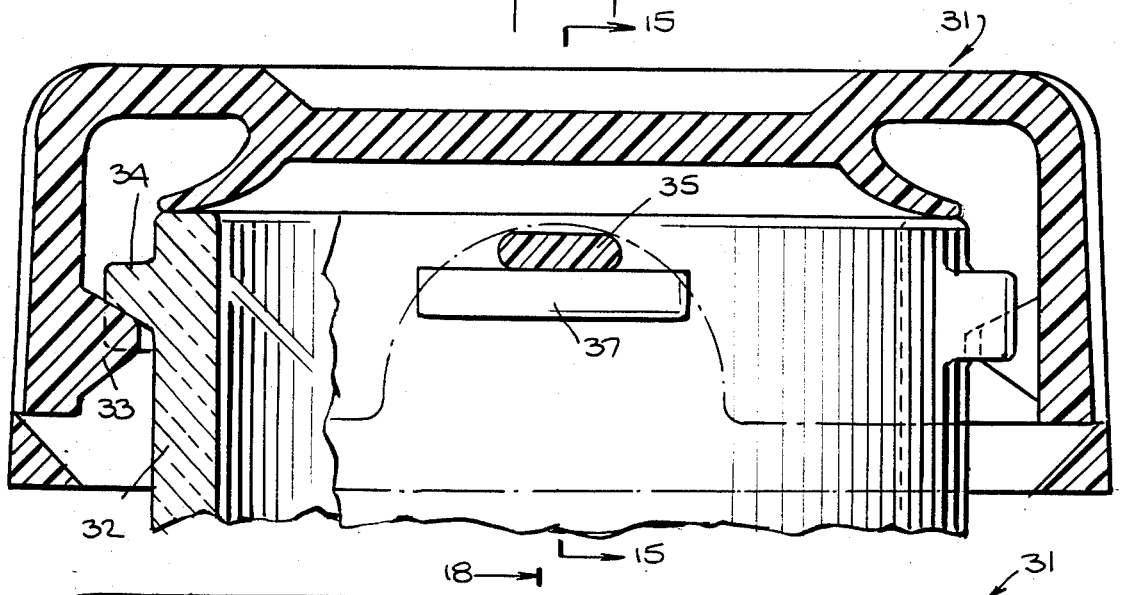
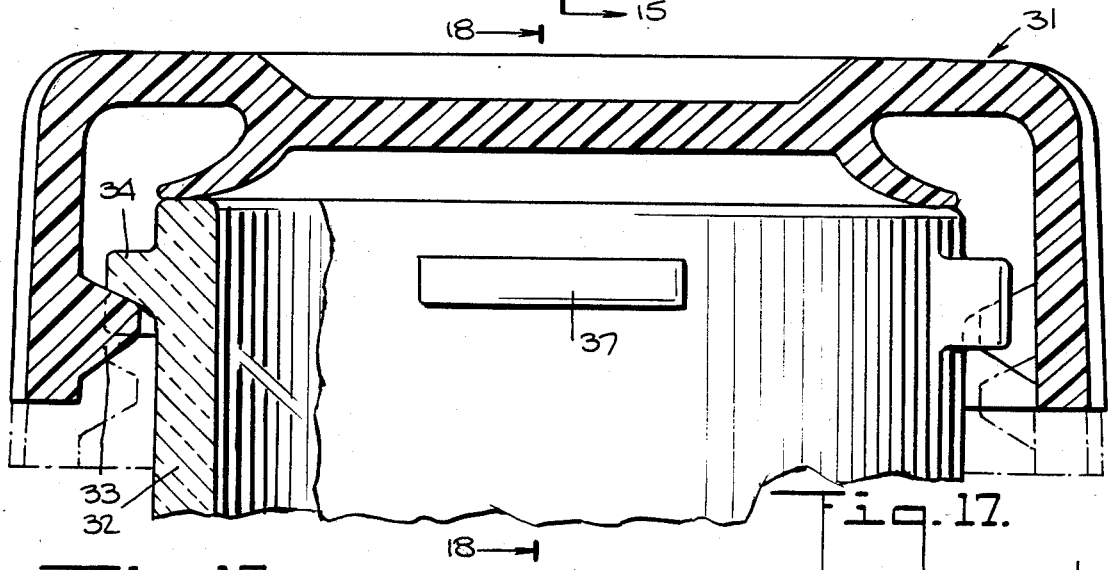
Fig. 17.
Fig. 19.
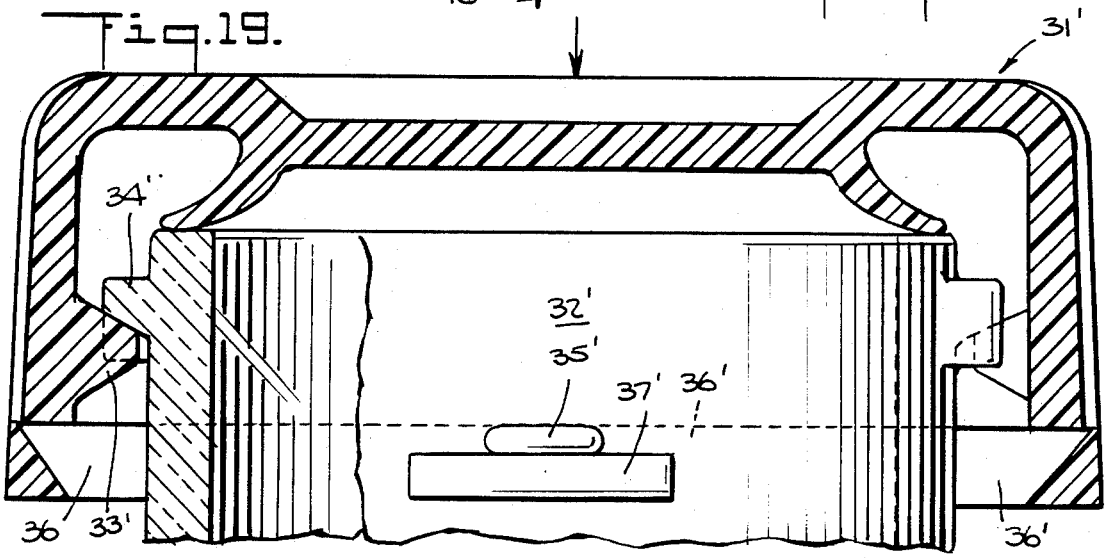

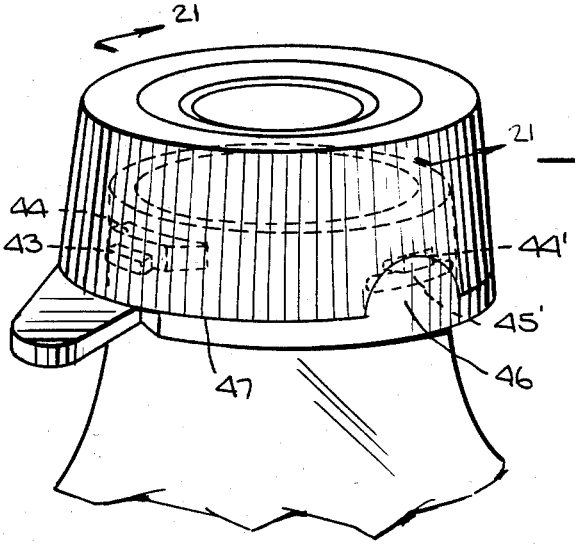
Fig. 20.
Fig. 21.
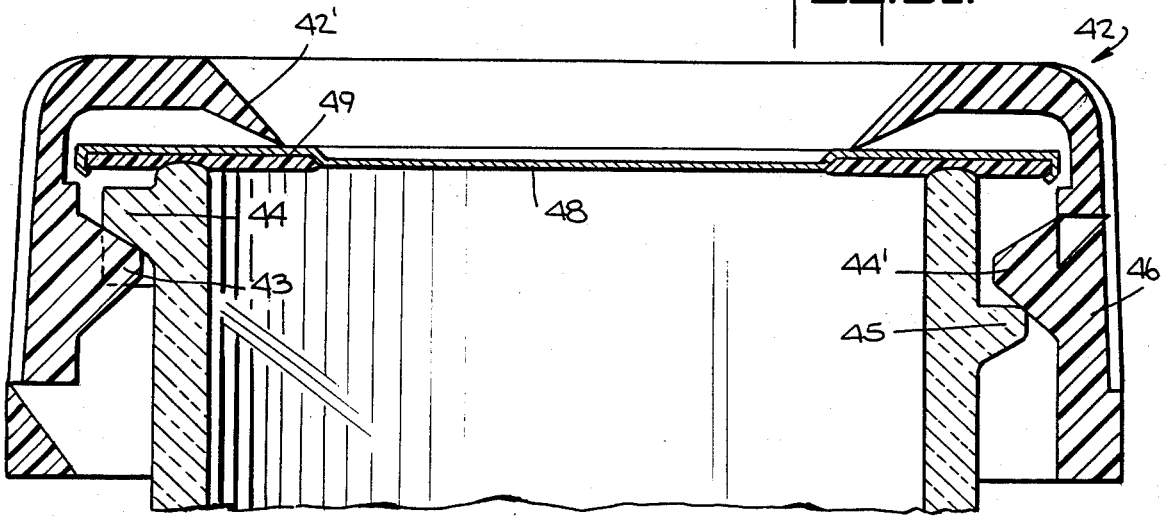
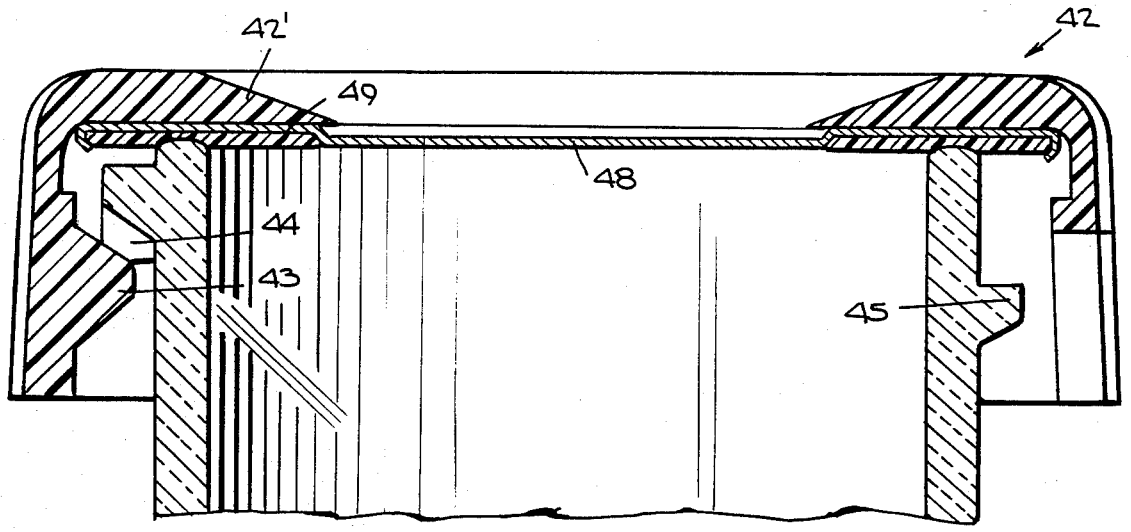
Fig. 22.

CHILD-RESISTANT TAMPER-EVIDENT CLOSURE

BACKGROUND OF THE INVENTION

The present invention relates to closure caps of the type which are used to seal containers and which are child-resistant and which may not be removed from the container without a clear indication to others that the package has been opened.

There are a number of presently known closure caps which are designed to provide an indication that they have been removed or partially removed from the container and there are other closures which are chiled-resistant. There is a growing problem in the use of regular closures in that these closures may be removed and reapplied without any indication that the packaged products have been exposed or tampered with. There have been a number of well-known incidents recently where there have been fatal results from unauthorized tampering with and the addition of harmful ingredients to otherwise tightly sealed packages. Additionally, there are continuing incidents of child poisoning resulting from young children opening drug packages and eating the contents.

The present closure cap represents an improvement over a number of prior closure caps which include a clear indication that there has been a previous and unauthorized opening of the sealed container as well as providing a child-resistant closure cap.

Accordingly, an object of the present invention is to provide an improved child-resistant tamper-evident closure.

Another object of the present invention is to provide a single and effective child resistant and tamper-evident closure.

Other and further objects of the present invention will be apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification wherein:

FIG. 1 is a perspective view of a preferred embodiment of the closure of the present invention.

FIG. 2 is a top plan view of the closure of FIG. 1.

FIGS. 3 and 4 are perspective views of a container with the closure being removed from the closure container.

FIG. 7 is a perspective view of a package sealed with another embodiment of a child-resistant tamper-evident closure in accordance with the present invention.

FIG. 8 is a top plan view of the closure cap of FIG. 7.

FIGS. 9 and 10 are perspective views of the sealed container of FIG. 7 being opened with the removal of a tamper indicating band.

FIGS. 11 and 12 are vertical sectional views of the closure of FIGS. 7-10 illustrating the closure before and during removal.

FIGS. 13 and 16 are perspective views of another embodiment of a child-resistant tamper-evident closure in accordance with the present invention.

FIGS. 14 and 15 are vertical sectional views of the closure of FIG. 13 taken along lines 14—14 and 15—15 on FIGS. 13 and 14 respectively.

FIG. 17 is a vertical sectional view of the embodiment of FIG. 13 illustrating the removal of the tamper-evident tear strip.

FIG. 18 is a vertical sectional view taken along line 18—18 on FIG. 17.

FIG. 19 is a vertical sectional view of another embodiment of the tamper-evident closure.

FIG. 20 is a perspective view of another embodiment of a closure cap in accordance with the present invention.

FIG. 21 is a vertical sectional view of a tamper-evident closure as taken along line 21—21 on FIG. 22.

FIG. 22 is a vertical sectional view of the closure of FIG. 20 with the tear strip removed.

DESCRIPTION OF THE PREFERRED EMBODIMENTS

This invention is a closure cap of the type known both as child-resistant and tamper-evident. In other words, the closure caps illustrated herein and described below are caps which may not ordinarily be removed by children and which at the same time have a second characteristic which is an indication that they have been fully or partially removed by unauthorized persons. Such closures are now commonly known as children-resistant and tamper-evident closures.

Figure 5:
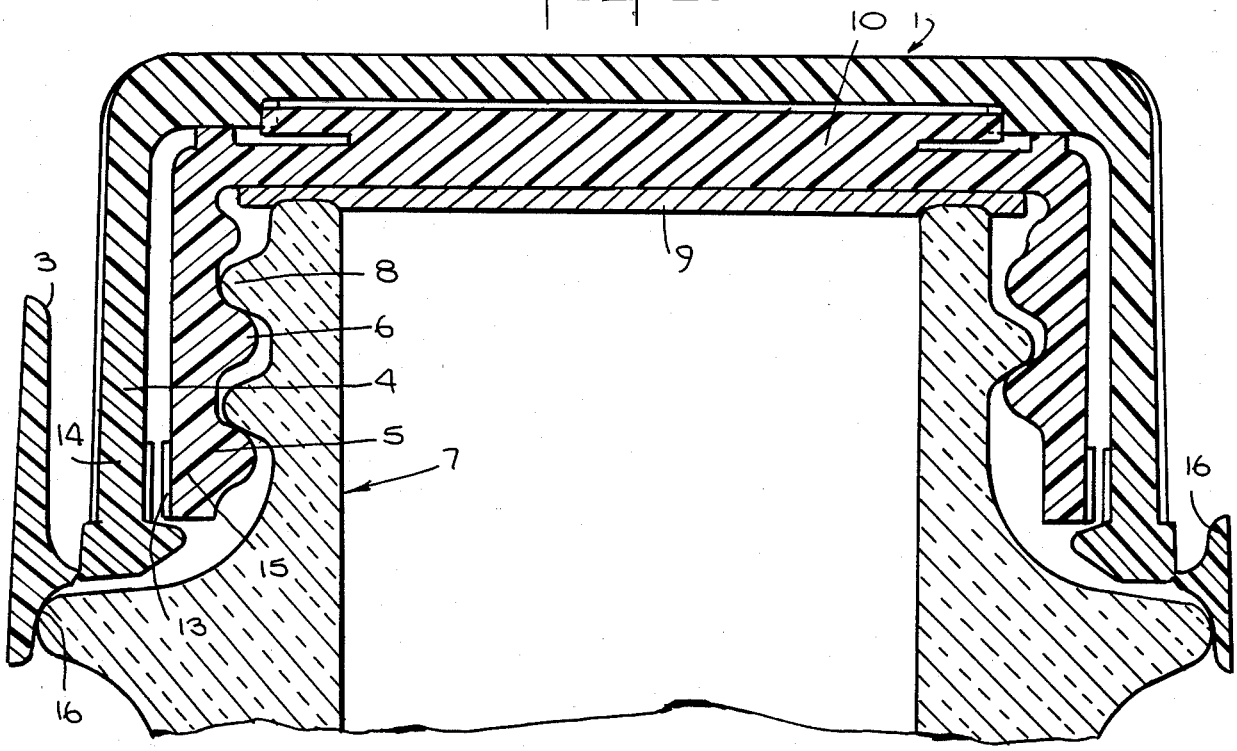
FIGS. 5 and 6 are vertical, sectional views of the closure taken along lines 5—5 and 6—6 respectively.
Figure 6:
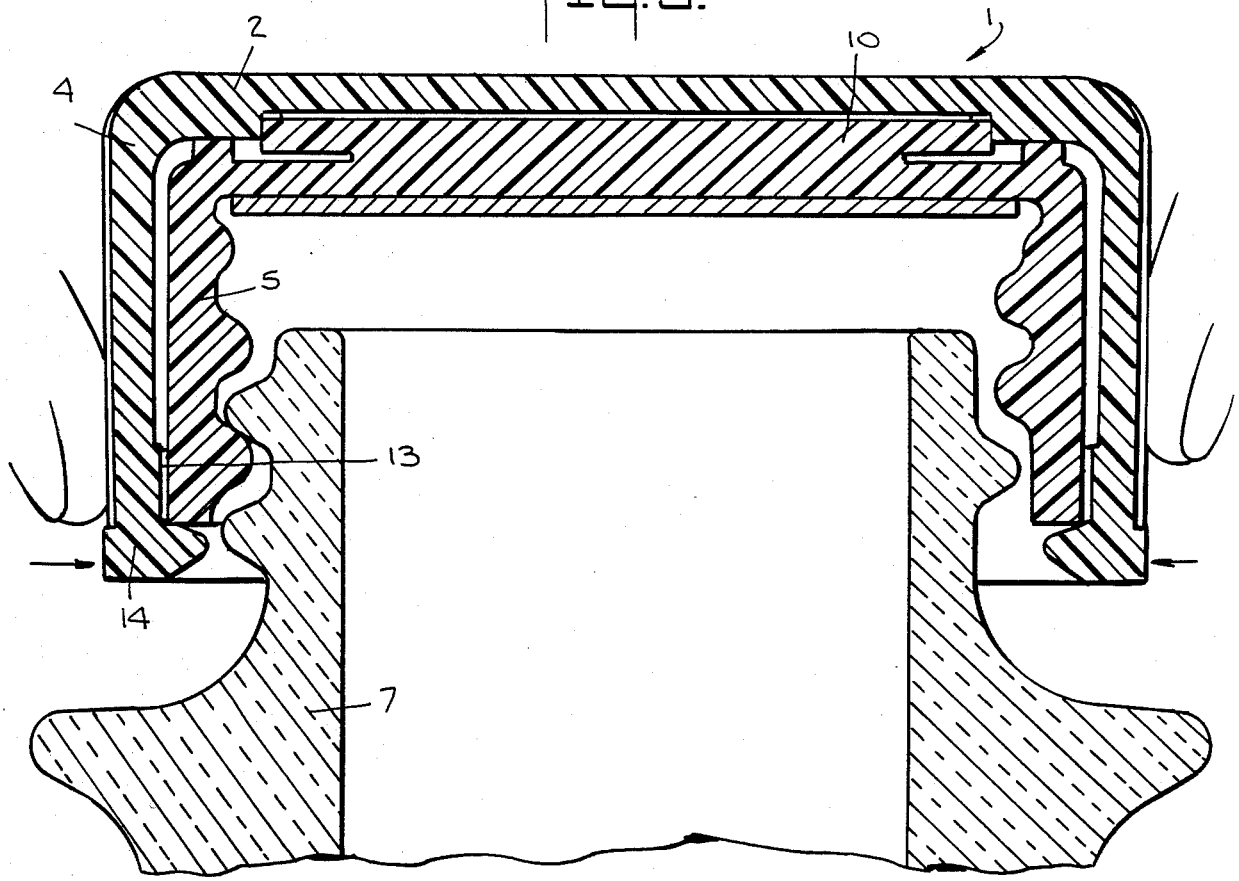

FIGS. 1 through 6 illustrate one embodiment of a child-resistant and tamper-evident closure 1. The closure 1 is formed in two main portions which comprise an outer closure shell 2 including an integral tamper-evident band 3 encircling and attached to the lower edge of the closure cap skirt 4. There is an inner cap or shell 5 having threads 6 for engaging the container 7 threads 8 and including a sealing gasket 9. A ratchet means 10 molded integrally with the inner and outer shells 2 and 5 includes pawl members 11 which engage ratchet teeth 12 on the outer shell 2 to provide a connecting force for turning the inner shell 5 onto the container 7 when the outer shell 2 is turned. Turning the outer shell 2 in the reverse or removal direction disengages the ratchet means 10 so that no removal torque is generated. For cap removal it is necessary to pinch or squeeze the outer shell 2 inwardly at the facing teeth or knurls 13 on the bottom of the outer and inner shell skirts 14 and 15. The tamper-evident band 3, which includes a downwardly projecting portion 16, prevents this movement so that the band 3 must be either removed prior to closure removal or it will be automatically torn loose as a result of the necessary squeezing action for removal. In either case, the absence or tearing of the band 3 indicates that an attempt has been made to remove the closure or that the closure has been removed and reapplied.

FIGS. 7 through 12 illustrate a further embodiment of a child resistant and tamper-evident closure. The closure cap 20 has a single shell 21 as best illustrated in FIGS. 7 and 11 which includes an integral molded tamper-evident band 22 molded as an integral part of the skirt 23 bottom 24. The container 25 includes a number of spaced lug stops 26 which receive and engage the inwardly projecting lugs 27 formed on the inner surface of the cap skirt 23. Ramps 28 on each lug stop 26 permit the cap 20 to be turned into its sealed position as illustrated in FIGS. 8 and 11. The lug receiving appertures 29 which hold the cap 20 in its sealed position prevent the cap lugs from being disengaged from the lug stop thereby preventing cap removal unless the cap is pressed downwardly to the release position illustrated in FIG. 12. A downwardly projecting fin 30 on the underside of the cap cover 31 provides a package seal as well as an upward force resisting downward movement of the closure cap. The positive blocking action of the tamper-evident band 22 prevents any downward movement of the closure 20 until the band 22 is removed by the user or destroyed in an attempt to open the package. Thus, if the band 22 is removed or disturbed, there is clear evidence that the package has been tampered with. After the initial opening, the fin 30 holds the cap upwardly on the sealed container to provide a child-resistant reseal. The closure must be pressed downwardly against the force of the fin 30 to move the cap lugs 27 clear of the lug stops 26 as illustrated in FIG. 12.

FIGS. 13 through 18 illustrate an additional embodiment of a child-resistant and tamper-evident closure. The closure 31 is applied by turning it onto the container 32 causing the cap lugs 33 to engage the spaced lug stops 34 provided at the container 32 mouth. In order to remove the closure cap by disengaging the lugs 33 from the lug stops 34, it is necessary to move the closure 31 axially downwardly on the container 32 to move the cap lugs 33 clear of the container lug stops 34. This movement is prevented by the spaced lugs 35 formed on a tamper-evident band 36 forming a lower portion of the closure skirt which engage support lugs 37 on the container mouth 32. This tamper-evident band 36, including a gripping member 38, is defined by a line of weakness 39 such as an interrupted slot or score line encircling the closure skirt 40. Ramps 34' on lug stops 34 facilitate cap application.

FIGS. 13, 14 and 15 illustrate the closure 31 in its initial sealed position on the container. Thus, FIG. 14 illustrates the lug 33 engaging the lug stop 34 on the container in its sealed position and the lug 35 resting as support lug 37. FIG. 17 illustrates the closure 31 after the removal of the tamper-evident band 36 showing the support lug 37 exposed permitting the closure 31 to be pressed downwardly to the removal position with the lugs 33 clear of the lug stops 34 as illustrated in FIGS. 18 and 19. In this position the cap 31 may be turned to remove the closure cap 31 from the container 32. When the tamper-evident band 36 is torn clear in the manner illustrated in FIG. 16, it is clearly evident that closure has been tampered with and the container made ready for opening or open. A resilient sealing rib 41 acts to hold the closure 31 upwardly after reseal to provide a child-resistant closure.

FIG. 19 illustrates another embodiment of a closure 31' of the general type illustrated in FIGS. 13 through 18. In this embodiment the support lugs 37' are positioned downwardly on the container 32' from the lug stops 34'. This permits the tamper-evident band 36' to be generally straight or ring-like without the vertical offsets employed on the embodiment of FIGS. 13 through 18. The lugs 35' are removed with the band 36' permitting the cap to be pressed downwardly with the lug 33' below the lug 34' and turned off.

FIGS. 20 through 22 illustrate an embodiment of a closure 42 of the same general type as that described in connection with FIGS. 13 through 19. The closure 42 includes the locking lugs 43 for engaging the container lugs 44 and also includes the container engaging lug 44' to prevent the cap from being pressed downwardly for removal by engaging a support lug 45. The lug 44' is removed by tearing the tamper indicating band 46 from the closure 42 along its line of weakness 47. The closure 42 has a separate metal closure cover 48 including an annular sealing gasket 49. Downwardly inclined cover portions 42' for assisting to keep the closure 42 in its sealed position for a child-resistant action after reseal.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. A tamper-indicating child resistant closure for a container having closure engaging members on its neck comprising the combination of:

a cup-like outer shell with a cover and a depending skirt;

a cup-like inner shell;

thread-like means on said inner shell for engaging said closure engaging members, ratchet means for coupling said shells only while being turned onto the container;

normally spaced friction means on the lower edges of said shells facing radially outwardly on the inner shell and radially inwardly on the outer shell for releaseably engaging said shells for cap removal; and removable means for releaseably holding said friction means disengaged.

2. The closure as claimed in claim 1 in which said removable means comprises a tear strip removably attached to said outer shell and including means for preventing radially inward movement of the lower edge of the outer shell.

3. The closure as claimed in claim 2 in which said tear strip has a grip on one end.

4. The closure as claimed in claim 1 in which said friction means comprises knurls.

* * * * *